US005178114A

United States Patent [19]

McArthur

[11] Patent Number: 5,178,114

[45] Date of Patent: Jan. 12, 1993

[54] FUEL RAIL END CLOSURE AND ELECTRICAL CONNECTOR

[75] Inventor: Robert A. McArthur, Waterford, Mich.

[73] Assignee: Siemens Automotive L.P., Auburn Hills, Mich.

[21] Appl. No.: 825,458

[22] Filed: Jan. 22, 1992

Related U.S. Application Data

[63] Continuation of Ser. No. 740,693, Aug. 6, 1991, abandoned.

[51] Int. Cl.[5] ..... F02M 39/00; H01R 9/09

[52] U.S. Cl. ..... 123/456; 123/468; 439/130

[58] Field of Search ..... 439/76, 79, 80, 130, 439/191, 199; 123/456, 468, 469, 470, 472

[56] References Cited

U.S. PATENT DOCUMENTS

| | | | |
|---|---|---|---|
| 4,570,601 | 2/1986 | Ito et al. | 123/468 |
| 4,836,246 | 6/1989 | Lemp | 137/561 A |
| 4,844,036 | 7/1989 | Bassler et al. | 123/470 |
| 4,857,002 | 8/1989 | Jensen et al. | 439/76 |
| 4,869,677 | 9/1989 | Johnson et al. | 439/80 |
| 4,895,124 | 1/1990 | Bartholomew | 123/468 |
| 4,950,171 | 8/1990 | Muzslay | 123/456 |
| 4,959,027 | 9/1990 | Muzslay | 439/130 |
| 5,016,594 | 5/1991 | Hafner et al. | 123/456 |
| 5,030,116 | 7/1991 | Sakai et al. | 123/456 |
| 5,058,554 | 10/1991 | Takeda et al. | 123/456 |
| 5,070,844 | 12/1991 | Daly | 123/456 |
| 5,086,743 | 2/1992 | Hickey | 123/456 |
| 5,127,382 | 7/1992 | Imoehl | 123/456 |

*Primary Examiner*—E. Rollins Cross
*Assistant Examiner*—Thomas Moulis
*Attorney, Agent, or Firm*—George L. Boller; Russel C. Wells

[57] ABSTRACT

The end of a fuel rail hole is closed by a closure member which contains electrical terminal means having an external portion that mates with a connector from a wiring harness and an internal portion that mates with circuitry on a carrier that is disposed within the hole and contains the fuel injectors.

7 Claims, 3 Drawing Sheets

FUEL RAIL END CLOSURE AND ELECTRICAL CONNECTOR

This is a continuation of copending application Ser. No. 07/740,693 filed on Aug. 6, 1991, now abandoned.

REFERENCE TO RELATED APPLICATIONS

This application is related to co-pending, commonly assigned Ser. No. 07/653,598, filed Feb. 11, 1991 and to a co-pending, commonly assigned division and continuation-in-part of Ser. No. 07/653,598, now abandoned.

FIELD OF THE INVENTION

This invention relates to fuel rails for internal combustion engines.

BACKGROUND AND SUMMARY OF THE INVENTION

The parent patent application that has been referenced above relates to a fuel rail that contains a novel fuel injector configuration which allows for certain reductions in the size of the envelope that is occupied by the fuel rail assembly on an internal combustion engine, particularly reductions in the extent to which the fuel injectors project transversely of the fuel rail. The exemplary fuel rail assembly comprises a circular cylindrical-walled tube within which essentially the entirety of each fuel injector is disposed so that the transverse dimension of the fuel rail assembly at the location of a fuel injector is essentially that of the O.D. of the tube. The tube may be either a separate tube that is itself ultimately attached to the engine, or means defining a hole in the engine manifold. The fuel injectors are mounted on a carrier to form a sub-assembly that is assembled into the tube by endwise insertion. The electrical leads for the fuel injectors run along the carrier to a receptacle that is at one lengthwise end of the completed fuel rail assembly. Pressurized liquid fuel fills the interior of fuel rail tube to immerse the fuel injectors. The injectors' nozzles, from which fuel is injected, are seated in a sealed manner in holes in the sidewall of the tube.

The fuel injectors themselves are unique. Rather than having a solenoid, an armature, a needle, and a seat coaxially arranged along the length of the fuel injector, as in conventional fuel injectors, each fuel injector has a magnetic circuit that encircles a spherical valve element. This sphere is resiliently urged by a cantilever spring blade toward closure of an outlet hole that is circumscribed by a frusto-conical seat. The sphere-encircling magnetic circuit may be considered to comprise four sides. The armature and the solenoid are disposed at two opposite sides. The stator has a U-shape whose base passes through the solenoid and whose legs form the remaining two sides. The armature is a bar of magnetically permeable material whose midpoint acts on the sphere. When the solenoid is not energized, working gaps exist between the ends of the bar and the distal ends of the stator's legs, and when the solenoid is energized, the magnetic flux attracts the bar to reduce these working gaps. As a result, the bar pushes the sphere out of concentricity with the seat to cause the outlet hole to open and pass the pressurized liquid fuel for injection. When the solenoid is de-energized, the cantilever spring pushes the sphere back to concentricity with the seat, and the resultant closure of the outlet hole terminates the injection. The fuel injector of the invention is well-suited for miniaturization to fit within a fuel rail and is an efficient and economical use of parts and materials.

The invention of the referenced division and continuation-in-part patent application relates to features of the fuel rail assembly and its method of manufacture. The fuel rail assembly comprises an elongated carrier that contains spaced apart cavities in which the fuel injectors are respectively disposed. The carrier also contains electric circuitry for operating the fuel injectors, and includes electrical terminals for making electrical circuit connection to a remotely located engine management computer which delivers principal command signals to the fuel rail assembly for operating the fuel injectors. The carrier-mounted electric circuitry also includes its own microprocessor, a calibration PROM (programmable read only memory, fuel injector drivers, and related auxiliary electronic circuit devices. These further electronic circuit components provide for the fuel rail assembly to be electronically calibrated for dynamic flow throughout the entire dynamic operating range. The inclusion of such electronic circuitry in the fuel rail assembly confers a number of substantial benefits, as described in detail in the referenced patent application. It becomes possible to fabricate a common fuel rail assembly that can be electronically customized and adapted to accommodate a multitude of varying uses and that will be properly calibrated for dynamic flow over its full range.

The invention that is the subject of the present patent application relates to an end closure and electrical connector for fuel rails of the type disclosed in the referenced patent applications, especially the later application.

In the fuel rail of the referenced parent application, the electrical connector is provided at one end of the carrier. Lead wires extend along the carrier from the fuel injectors to the electrical connector. With the carrier having been assembled into the main longitudinal hole in the fuel rail tube, the connector will be disposed at an open end of that tube which is subsequently closed by a suitably shaped closure that allows the connector to be exposed to the exterior of the fuel rail and to be mated with a complementary connector of a wiring harness that leads to the engine management computer which delivers signals to the fuel rail assembly for operating the fuel injectors.

The present invention proposes a combined fuel rail end closure and electrical connector which will provide certain advantages and benefits for such a fuel rail assembly. One of the chief benefits is that sealing of the end closure and electrical connector can be accomplished at a single pair of confronting circular surfaces, one surface being on the tube and the other on the end closure and electrical connector. For example, the surfaces may be telescopically engaged, and an O-ring seal provided between them. Because the end closure and electrical connector has not yet been assembled to the carrier at the time of assembly of the carrier to the tube, the possibility that it will impede or complicate the process of assembling the carrier to the tube is foreclosed.

Further features, advantages, and benefits of the invention, along with those already mentioned, will be seen in the ensuing description and claims, which are accompanied by drawings. The drawings disclose a presently preferred embodiment of the invention according to the best mode contemplated at the present time in carrying out the invention.

DESCRIPTION OF THE PREFERRED EMBODIMENT

Figure 1:
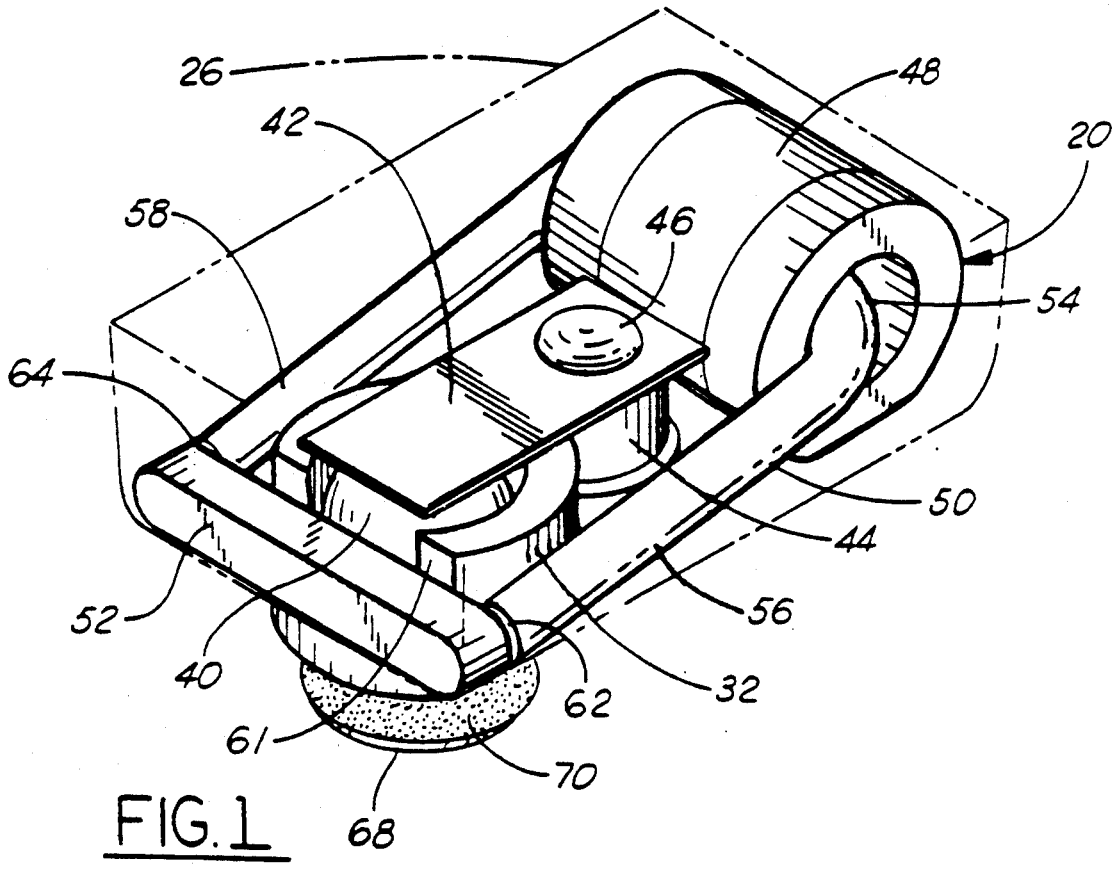
FIG. 1 is a perspective view illustrating the general organization and arrangement of a preferred fuel injector for a fuel rail assembly embodying principles of the invention.

FIG. 1 discloses an exemplary fuel injector 20 that may be used in a fuel rail assembly that embodies the present invention. As revealed in subsequent drawing Figs., there are several similar fuel injectors disposed on a carrier 22 that fits within a circular cylindrical walled tube 24.

For each injector 20, carrier 22 comprises a somewhat rectangular-shaped well 26 which has a sidewall and a bottom wall. Each injector comprises a seat member 32 that has a frustoconical seat that funnels to an outlet hole. The seat and outlet hole share a co-axis which is perpendicular to the bottom wall of well 26, and the bottom wall has a suitably-shaped hole allowing seat member 32 to fit therein. A sphere 40 is seated on the seat, and all Figs. show the sphere concentric with the co-axis in closure of the outlet hole in the seat member. The sphere is resiliently urged to such concentricity by an overlying flat spring blade 42 which is cantilever-mounted atop an upright post 44 on wall 30 aside seat member 32. Blade 42 is essentially parallel with the bottom wall of well 26. The cantilever mounting of the blade on the post is accomplished by means of a hole in the blade through which a close-fitting pin on the post passes and a head 46 on the pin which overlaps the margin of the hole in the blade to hold the corresponding end of the blade securely on the top of post 44. Although the blade is flat and essentially parallel with the bottom wall of the well, the spring exerts a pre-load force on sphere 40 when the sphere is concentric with the co-axis.

The injector has a magnetic circuit that encircles sphere 40 and is composed of a solenoid coil 48, a stator 50, and an armature 52. The magnetic circuit may be considered to have a generally four-sided rectangular shape for fitting into well 26. Coil 48 and armature 52 form two opposite sides while the remaining two sides, which are opposite each other, are formed by portions of stator 50. Coil 48 is disposed in well 26 with its axis parallel to the bottom wall of the well and spaced from the co-axis of the seat and outlet hole in member 32. Stator 50 is generally U-shaped, comprising a base 54 that passes through coil 48 and parallel legs 56, 58 that extend from base 54 to form two opposite sides of the magnetic circuit. Armature 52 is in the form of a bar that is disposed along side sphere 40 and operated by the magnetic circuit to act on the sphere at essentially the midpoint of the bar. Seat member 32 contains a suitably shaped notch that allows the armature to act on the sphere. In the condition portrayed in FIG. 1, which is for the solenoid coil not energized, the opposite ends of the bar are spaced from the distal ends of legs 56, 58 by generally equal working gaps 62, 64, and the midpoint of the armature is in contact with the sphere at the end of a particular radial of the sphere. When the solenoid coil is energized, the magnetic flux that is generated in the magnetic circuit operates to reduce working gaps 62, 64 by attracting armature 52 toward the ends of the stator's legs 56, 58. This causes armature 52 to be moved bodily predominantly along the direction of an imaginary line that intersects the co-axis and that when viewed along the co-axis is essentially coincident with the radius of the sphere whose end is contacted by the midpoint of the armature. The cooperative effect of the motion of armature 52, of the resilience of spring blade 42, and of the angle of the seat in member 32 is such that the sphere is moved from concentricity with the co-axis of the seat and outlet hole to eccentricity therewith and the resultant opening of the outlet hole in the seat member. Sphere 40 is actually caused to roll slightly up the seat in the direction toward post 44. When energization of the solenoid coil terminates, the magnetic attractive force that stator 50 had been exerting on the armature ceases, and this enables the resiliency of spring blade 42 to return the sphere to concentricity with the co-axis of the seat and outlet hole and resulting closure of the outlet hole.

The outlet hole is surrounded by the tip end, or nozzle, 68 of the fuel injector at which fuel is injected into the engine. An O-ring seal 70 is seated in a groove extending around the sidewall of the injector tip end. Metering of injected fuel can be performed by a thin orifice disc (not shown) mounted on the injector tip end in covering relation to the outlet hole.

Electric lead wires from the injectors extend along carrier 22 to a circuit board assembly 100 that is also mounted on the carrier. The solenoid coils, stators, and seat members are secured within the carrier wells by any suitable means of securement. The fuel injectors shown in FIGS. 2 and 3 differ from the one in FIG. 1 only in that the cantilever mounting of spring blade 42 is on the opposite side of the seat member from solenoid coil 48. This allows the magnetic circuit path to be shortened since the solenoid coil can be placed closer to the seat and the legs 56, 58 of the stator can be shorter.

Figure 2:
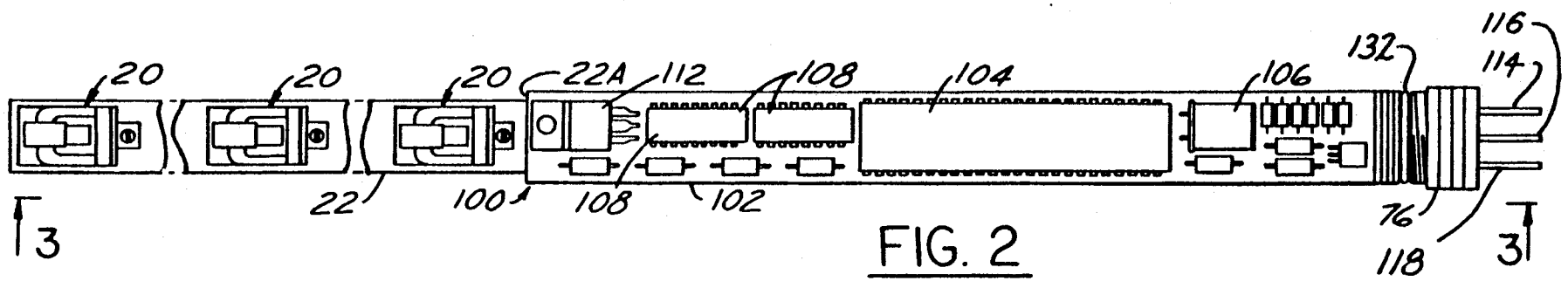
FIG. 2 is a top plan view of a carrier used in the fuel rail assembly, and includes the inventive end closure and electrical connector thereon.
Figure 3:
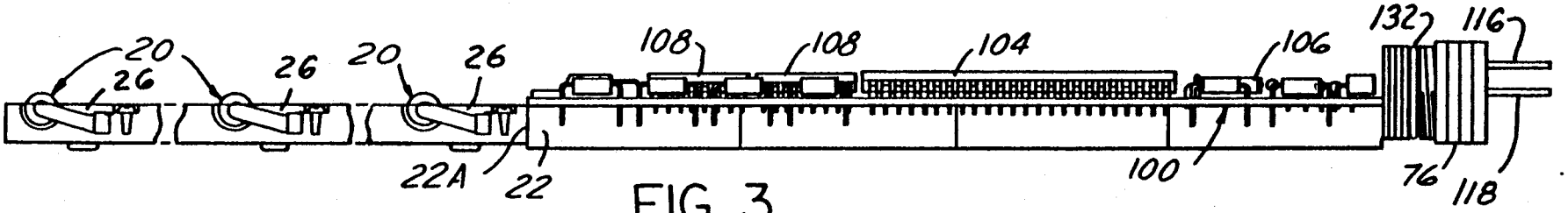
FIG. 3 is a view in the direction of arrows 3—3 in FIG. 2.

The combination of the carrier, the injectors, and the circuit board assembly forms a sub-assembly that is assembled into tube 24 by insertion through one end of the tube. (Although FIGS. 2 and 3 show the inclusion of an end closure and electrical connector 76 assembled to the sub-assembly, it is actually united with the sub-assembly only after the latter has been assembled into tube 24.) The sub-assembly has an envelope that is smaller than the main longitudinal hole through tube 24. Carrier 22 has a generally semi-circular transverse cross sectional shape that is on a radius smaller than that of the I.D. of tube 24. The sub-assembly is inserted into the tube to align the injector tip ends 68 with corresponding circular holes 82 through the wall of the tube. It is then displaced radially to pass the tip ends into holes 82 so that O-rings 70 seal between the tip ends and the holes in fluid-tight manner. Such assembly is performed before end closure and electrical connector 76 is assembled onto the tube end and circuit board assembly. A keeper (not shown) is then inserted via the same open end of the tube into space overlying the sub-assembly, said space being between the sub-assembly and the semi-circumference of the tube wall that is generally opposite holes 82. Further details of the keeper can be obtained from the referenced co-pending applications. The illustrated embodiment has a shoulder 22A in carrier 22 which divides the carrier into a smaller radiused section lying to the left in FIGS. 2 and 3, and a larger radiused section to the right. The tube 24 has a corresponding internal shoulder so that in the completed fuel rail assembly each approximately semi-circularly curved section will fit closely to a corresponding internal section of the tube.

After the sub-assembly has been assembled into the tube, an end closure and electrical connector 76 is assembled to both close the end of the tube through which the sub-assembly was inserted and make electric circuit connection with conductors on circuit board assembly 100. End closure and electrical connector 76 serves to connect circuitry on circuit board assembly 100 to the engine management computer (not shown) so that the computer, acting through electronic circuitry on the circuit board assembly, will operate the injectors at the proper times and for the proper durations.

In use, pressurized liquid fuel is introduced into tube 24 via a closure 120 containing a through-nipple 122. The closure is disposed at the end opposite the end via which the sub-assembly was inserted. The fuel injectors are essentially completely immersed in fuel, and when each is operated, it will inject fuel from its nozzle 68. This particular fuel rail assembly configuration is intended for use in a "dead-head" type system where the fuel pressure in the rail is controlled by the control of an electric motor driven pump, and a mechanical pressure regulator with a fuel return line for returning excess fuel to tank is not used.

The several electronic devices on circuit board assembly 100 include a microprocessor 104 with associated crystal 106, fuel injector drivers 108, a PROM 110, and a voltage regulator 112. End closure and electrical connector 76 comprises three terminals 114, 116, 118. DC electric power (+V volts referenced to Ground) is delivered through a first (+V) and a second (Ground) of these terminals to the self-contained electronics on the circuit board assembly, and voltage regulator 112 converts the delivered power to regulated DC level for microprocessor 104 and drivers 108. Principal command signals (referenced to ground) delivered by the engine management computer to the fuel rail assembly pass through the third terminal (Signal) to a serial input port of microprocessor 104. The microprocessor output ports are connected to inputs of the respective drivers via the board, and the drivers' outputs are connected by respective conductors extending from the board along the carrier to the respective fuel injectors. The microprocessor acts on the principal command signals to produce corresponding operation of the fuel injectors. In other words, the principal command signals received by the self-contained electronics represent the pulse widths of signals that should cause the fuel injectors to deliver corresponding injections of fuel into their respective portions of the engine's induction system. As explained in detail in the later referenced co-pending, commonly assigned patent application, dynamic flow calibration is electronically performed on the fuel rail assembly during its manufacturing process so that such correspondence is assured despite the presence of certain differences in the operating characteristics of different components. Circuitry on circuit board assembly 100 is used to perform such calibration.

Figure 5:
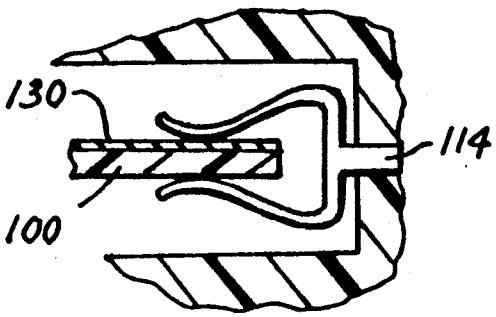
FIG. 5 is an enlarged fragmentary view in the direction of arrows 5—5 in FIG. 4, but illustrating a portion of the inventive end closure and electrical connector in association therewith.
Figure 4:
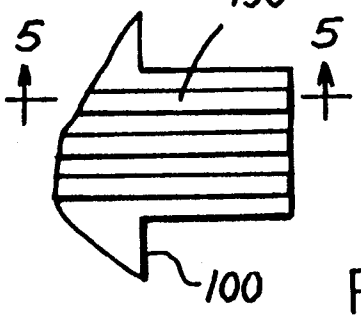
FIG. 4 is an enlarged fragmentary top plan view of the right hand end portion of the carrier of FIGS. 2 and 3 by itself without the inventive end closure and electrical connector thereon.
Figure 6:
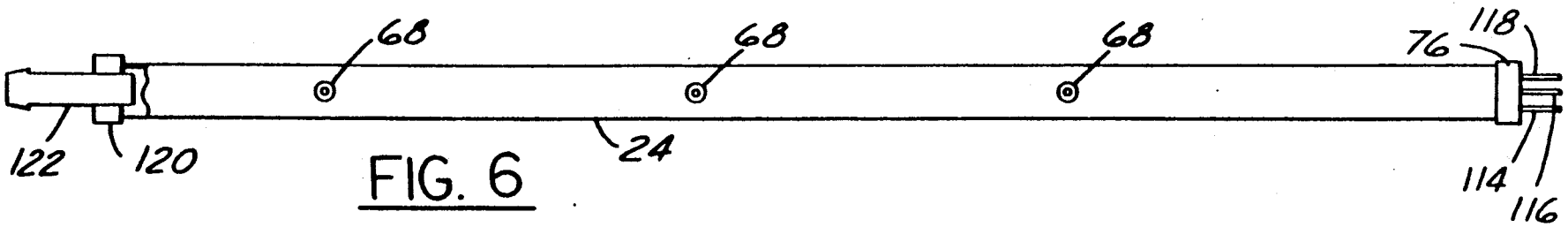
FIG. 6 is a bottom plan view of the completed fuel rail with a portion broken away for illustrative purposes.

The three terminals 114, 116, 118 have an exterior configuration for mating with a complementary connector and an interior configuration for mating with circuit board assembly 100. FIGS. 4 and 5 show an exemplary interior configuration for one of the terminals 114 and it is to be understood that each terminal has a similar interior configuration. The interior configuration for terminal 114 comprises a push-on edge connector that fits over the edge of the circuit board assembly to make electrical contact with a corresponding conductor 130 that has been deposited on the surface of the circuit board. The conductor 130 in turn leads to the electronic circuitry on the board. The circular cylindrical outside of end closure and electrical connector 76 contains an O-ring seal 132 in a groove. The O-ring seal provides a fluid-tight fit of the end closure and electrical connector to the I.D. of tube 24. After it has been assembled, to the tube and mated with the circuit board assembly 100, the end closure and electrical connector may be joined by any conventional means of attachment to the tube to secure it in place. The terminals 114, 116, and 118 extend through the body of member 76 and are sealed thereto in conventional fashion. Each terminal may be of one-piece or multiple-piece construction.

Figure 7:
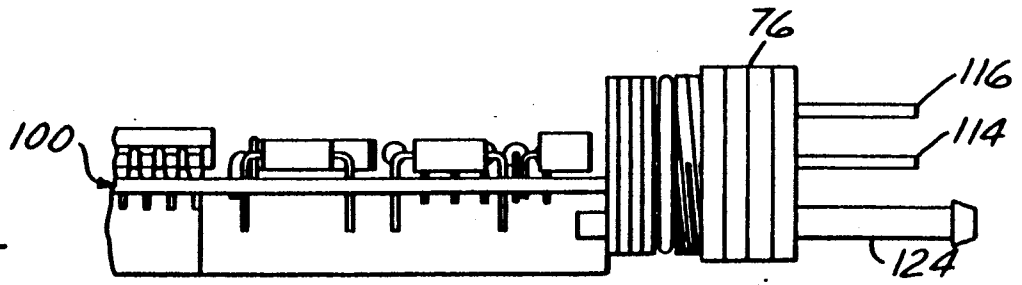
FIG. 7 is a fragmentary view similar to the right hand end of FIG. 3 illustrating a modified form.

If a fuel rail assembly like the one just described were used in a system having a mechanical fuel pressure regulator and a return line, the return line connection could be provided in end closure and electrical connector 76, as shown in FIG. 7, to include a through-nipple 124 through which excess fuel from such a fuel rail mounted pressure regulator would be returned to tank. Although not explicitly depicted in FIG. 7, it is understood that the interior end of through-nipple 124 is fluid coupled by a conduit to the return port of the pressure regulator, and that the through-nipple is in no way in direct communication with the pressurized fuel in the rail.

It is contemplated that certain plastics may be useful for certain parts. For example, carrier 22, tube 24, and cover 78 can be made from plastics that are inert when placed in a wet fuel environment, and of course all materials that are exposed to fuel must be inert to the particular fuel composition or compositions that are used.

While a presently preferred embodiment has been illustrated and described, it should be understood that principles of the invention may be practiced in other equivalent ways.

What is claimed is:

1. A fuel rail assembly comprising means defining an elongated hole, a carrier inserted into said hole, said carrier including electric operated fuel injectors that have nozzles which are sealed to holes in the wall of said means for injecting fuel therefrom, electrical terminations providing for the fuel rail assembly to be connected to a source of electric power and signals for operating the fuel injectors, said terminations being disposed in an end closure and electrical connector member that forms a sealed closure with an end of said hole, said terminations have exterior portions for mating connection with complementary terminations providing such electric power and signals and interior portions making electric connection with conductors on said carrier via which said signals and electric power are delivered to said carrier to operate said fuel injectors.

2. A fuel rail assembly as set forth in claim 1 in which said carrier includes a circuit board assembly contains said conductors.

3. A fuel rail assembly as set forth in claim 2 in which said conductors are on a flat surface portion of said circuit board assembly and said interior portions of said terminations fit over an edge of said circuit board assembly to make connection with said conductors.

4. A fuel rail assembly as set forth in claim 1 including a through-nipple in said end closure and electrical connector member for conducting liquid fuel flow into or out of said hole.

5. The method of making a fuel rail assembly which comprises inserting a carrier into a hole, said carrier comprising fuel injectors and electrical conductors forming terminations, and closing an end of said hole with an end closure and electrical connector member to close said end and in the process establish electrical continuity between a corresponding one of each of said terminations and a corresponding one of terminals that extend through said member to form a corresponding external termination with which a corresponding mating termination from a wiring harness connector can be made.

6. A fuel rail assembly comprising a walled fuel rail member comprising a main fuel passage, including an opening, that serves one or more electric operated fuel injectors that are disposed within said passage and have nozzles which are sealed to holes in the wall of said member for injecting fuel therefrom, electrical terminations providing for the fuel rail assembly to be connected to a source of electric power and signals for operating the fuel injectors, said electrical terminations being disposed in an end closure and electrical connector member that forms a sealed closure with said opening of said passage, said terminations have exterior portions for mating connection with complementary terminations providing such electric power and signals and interior portions making electric connection with conductors which extend along said member and via which said signals and electric power are delivered to operate said fuel injectors.

7. A fuel rail assembly as set forth in claim 6 in which said conductors are disposed entirely within said passage.

* * * * *